US012319986B2

(12) United States Patent
Yamamoto et al.

(10) Patent No.: US 12,319,986 B2
(45) Date of Patent: Jun. 3, 2025

(54) ALUMINUM ALLOY AND ALUMINUM ALLOY DIE CASTING MATERIAL

(71) Applicants: NIPPON LIGHT METAL COMPANY, LTD., Tokyo (JP); NIKKEI MC ALUMINIUM CO., LTD., Tokyo (JP)

(72) Inventors: Izumi Yamamoto, Shizuoka (JP); Tomohiro Isobe, Shizuoka (JP); Hiroshi Horikawa, Tokyo (JP)

(73) Assignees: NIPPON LIGHT METAL COMPANY, LTD., Tokyo (JP); NIKKEI MC ALUMINIUM CO., LTD., Tokyo (JP)

( * ) Notice: Subject to any disclaimer, the term of this patent is extended or adjusted under 35 U.S.C. 154(b) by 796 days.

(21) Appl. No.: 17/439,997

(22) PCT Filed: Mar. 6, 2020

(86) PCT No.: PCT/JP2020/009593

§ 371 (c)(1),
(2) Date: Sep. 16, 2021

(87) PCT Pub. No.: WO2020/189325

PCT Pub. Date: Sep. 24, 2020

(65) Prior Publication Data

US 2022/0170137 A1 Jun. 2, 2022

(30) Foreign Application Priority Data

Mar. 20, 2019 (JP) ..... 2019-052297

(51) Int. Cl.
*C22C 21/02* (2006.01)
*C22F 1/043* (2006.01)
*C22C 21/04* (2006.01)

(52) U.S. Cl.
CPC ..... *C22C 21/02* (2013.01)

(58) Field of Classification Search
CPC ..... C23C 21/02; C23C 21/04; C22F 1/043; C22C 21/02; C22C 21/04
See application file for complete search history.

(56) References Cited

U.S. PATENT DOCUMENTS

2018/0002797 A1* 1/2018 Oh ..... C23C 2/16

FOREIGN PATENT DOCUMENTS

EP 1413636 A1 * 4/2004 ..... C22C 21/02

* cited by examiner

*Primary Examiner* — Lois L Zheng
(74) *Attorney, Agent, or Firm* — RANKIN, HILL & CLARK LLP

(57) ABSTRACT

Provided are a non-heat-treated aluminum alloy which has excellent casting properties and is high in both strength and toughness, and an aluminum alloy die casting material which is high in both strength and toughness, and which, in addition to having minimal difference in characteristics between regions thereof, is not prone to be affected by aging. An aluminum alloy comprises Si: 5.0 to 12.0% by mass, Mn: 0.3 to 1.9% by mass, Cr: 0.01 to 1.00% by mass, Ca: 0.001 to 0.050% by mass, with the balance being Al and unavoidable impurities, and the content of Mg in the unavoidable impurities being less than 0.3% by mass.

11 Claims, 2 Drawing Sheets

ALUMINUM ALLOY AND ALUMINUM ALLOY DIE CASTING MATERIAL

TECHNICAL FIELD

The present invention relates to a non-heat treatable type aluminum alloy and an aluminum alloy die casting material by using the aluminum alloy.

PRIOR ARTS

In transportation equipment such as automobiles, since efforts have being made to reduce the weight with the aim of improving fuel efficiency and reducing the environmental burden, as a material for vehicle members, attention has been paid to aluminum alloy, which is lighter than iron. Though there are various methods for manufacturing vehicle members using aluminum alloys, a die casting method can be mentioned as a method suitable for mass production at low cost.

When manufacturing a member with a complicated shape, as compared with the method of forming the member by applying plastic working to the wrought material, the die casting method is advantageous in terms of cost, because according to the die casting method, a shape closer to the final shape can be obtained at the time of casting, and thus the number of post-processing steps is reduced. However, in order to obtain the mechanical properties required for vehicle members in die casting materials, heat treatment is often required for the cast products. Heat treatment includes the solution treatment where the material is heated at a high temperature for a long time and the aging treatment where the material is heated and held at a relatively low temperature, but there are many additional factors for increasing the cost for both treatments, because the processes require long time of work, and, in addition, incur non-negligible fuel costs in the heating process, and in addition, even after the heat treatment, it is necessary to correct the strain of the member generated due to heating and cooling. In view of these, it cannot be said that the cost reduction effect by employing the die casting method in the manufacturing of the members can be sufficiently exhibited. Therefore, a non-heat-treatable type alloy that does not require heat treatment after casting is regarded as important in that the manufacturing cost can be further reduced.

Considering these backgrounds, when selecting a material for vehicle members, since there is a trade-off relationship between the mechanical properties required for the target member and the manufacturing cost, it has been desired to realize the imparting high mechanical properties, particularly strength and toughness required for vehicle members to the non-heat-treatable type aluminum alloy for die casting, which leads to expansion of the applicable range of the non-heat-treatable type aluminum alloy and has the effect of reducing the vehicle manufacturing cost.

Here, as the non-heat-treatable type aluminum alloy for die casting, there are Al—Si—Mg—Fe-based alloys, Al—Si—Cu—Mg-based alloys, Al—Mg—Mn-based alloys, and the like. Further, as a typical alloy type in the die casting material for vehicle members, ADC12 defined by the JIS standard can be mentioned.

In alloys for castings and die castings, Mg is an element that is often added and, though having the effect of improving the strength of members by being solid-dissolved in a matrix or precipitating as an $Mg_2Si$ compound, there is a concern about the following adverse effects.

Among the aluminum alloy members used in vehicles, casting materials or die casting materials tend to be used for those having a complicated shape, and the mold used at the time of casting often has a complicated shape. When casting by using a mold having such a shape, the cooling rate of the molten metal varies depending on the portion of the member. Since the solid dissolution of Mg to the matrix has a high concentration in the part where the cooling rate is high and a low concentration in the part where the cooling rate is low, the difference in the amount of solid solution generated at this time causes a difference in mechanical properties depending on the portion.

In addition, when an alloy in which Mg is solid-dissolved in a matrix is applied to a material for vehicle members, there is also a risk that the elongation will decrease due to the influence of the aging near a high temperature region such as an engine, or due to the influence of natural aging when used for a long period of time.

Further, as a problem at the time of casting, when Mg is contained in the molten aluminum alloy, the formation of an oxide film on the surface of the molten metal becomes remarkable, which causes surface defects in the product and, depending on the shape of the mold, forms a molten metal boundary at the confluence of molten metal, and, as a result, there is a case that the mechanical properties required for the member cannot be imparted.

In addition, with regard to casting, efforts are being made to achieve both lightness and strength of the member by devising the structural design, and it is expected that the demand for making the member into a difficult-to-cast shape will continue in the future. Under these circumstances, the value of improving castability in aluminum alloys is not limited to the ability to supply products with stable quality, but also increases the degree of freedom in structural design, leading to improvements in the mechanical properties of the members.

Here, as an alloy for die casting that does not contain Mg or has a low content of Mg, ADC12 defined in JIS standard is typical, and is used as a practical alloy. However, since the range of adoption of aluminum alloy members is expanding, and the toughness required for vehicle members is becoming higher, the development of aluminum alloys having further higher mechanical properties is required.

On the other hand, as an aluminum alloy that realizes a high level of toughness without heat treatment, and has Mg that is suppressed to a relatively low concentration, for example, Patent Literature 1 (Japanese Patent No. 6446785) discloses an aluminum alloy casting material containing, by mass ratio, Si of 6.00% or more to 7.50% or less, Mg of 0.02% or more to less than 0.20%, Zr of 0.05% or more to 0.20% or less, Fe of 0.20% or less, Mn of 0.15% or more to 0.80% or less, and Mo of 0.03% or more to 0.20% or less, Ti of 0.20% or less, and the balance being Al and inevitable impurities. According to this invention, the alloy casting material has excellent castability and high ductility in the state of the casting material and where aging more after casting is suppressed or prevented.

CITATION LIST

Patent Literature

Patent Literature 1: Japanese Patent No. 6446785

Technical Problem

However, due to the growing need for weight reduction of vehicles, more excellent castability, high strength and toughness are required as compared with the aluminum alloy and the aluminum alloy die casting material proposed in Patent Document 1.

Considering the above problems in the prior arts, an object of the present invention is to provide a non-heat-treated aluminum alloy which has excellent casting properties and is high in both strength and toughness. Also another object of the present invention is to provide an aluminum alloy die casting material which is high in both strength and toughness, and which, in addition to having minimal difference in characteristics between regions thereof, is not prone to be affected by aging.

Solution to Problem

As a result of intensive study on aluminum alloys for die casting and aluminum alloy die casting materials in order to achieve the above object, the present inventors have found that avoiding solid solution strengthening and precipitate strengthening by Mg, and adding appropriate amounts of Cr and Ca are extremely effective, and have arrived at the present invention.

Namely, the present invention can provide an aluminum alloy, containing

Si: 5.0 to 12.0% by mass,

Mn: 0.3 to 1.9% by mass,

Cr: 0.01 to 1.00% by mass,

Ca: 0.001 to 0.050% by mass, with the balance being Al and unavoidable impurities, and the content of Mg in the unavoidable impurities being less than 0.3% by mass.

In the aluminum alloy of the present invention, in the unavoidable impurities, the Mg content is strictly regulated to a low value. As a result, the influence of aging deterioration of the members due to the artificial aging and the natural aging is reduced. In addition, the variation in characteristics depending on the portion of the member due to the difference in Mg content is reduced. Further, the oxidation of the molten metal during casting is reduced, the flow of the molten metal is improved, and excellent castability is realized.

Here, in the aluminum alloy of the present invention, though the reinforcement by Mg cannot be utilized, the high strength and toughness are realized by adding Cr and Ca. Specifically, the proof stress is mainly improved by dissolving Cr in the matrix, and the eutectic Si structure is refined by adding Ca, to mainly improve the elongation (toughness). Further, by optimizing the addition amounts of these elements, the high strength and toughness can be imparted to the aluminum alloy.

Further, by containing an appropriate amount of Si, the aluminum alloy of the present invention realizes a good flow of the molten metal and has good castability. Further, by containing an appropriate amount of Mn, it is prevented that the molten metal is seized on the mold during casting. Furthermore, by defining the upper limit of the contents of these elements, the decrease in toughness of the aluminum alloy is suppressed.

In the aluminum alloy of the present invention, the Cr content is preferably 0.1 to 0.5% by mass. By setting the Cr content to 0.1% by mass or more, the effect of improving the strength by adding Cr can be sufficiently obtained, and by setting to 0.5% by mass or less, addition of Cr that does not contribute to solid solution strengthening can be suppressed. Namely, it is possible to prevent the increase in cost due to the addition of unnecessary Cr.

Further, in the aluminum alloy of the present invention, it is preferable that Fe is 0.4% by mass or less in the unavoidable impurities. Generally, Fe is added for the purpose of preventing the molten metal from being seized onto the mold during casting. However, the addition of Fe produces Al—Fe—Si compounds and Fe—Si compounds, and these compounds reduce the ductility of the aluminum alloy. Since in the aluminum alloy of the present invention, it is necessary to exhibit high toughness (ductility), the Fe content is preferably 0.4% by mass or less, more preferably 0.2% by mass or less.

Further, in the aluminum alloy of the present invention, when further adding one or more of Ti: 0.05 to 0.20% by mass, B: 0.005 to 0.100% by mass, and Zr: 0.05 to 0.20% by mass, the microstructure of the aluminum alloy member can be made finer to impart higher toughness.

Further, the present invention also provides an aluminum alloy die casting material, which comprises the aforementioned aluminum alloy of the present invention, and has a tensile property of 0.2% proof stress of 110 MPa or more and elongation of 10% or more.

Since the aluminum alloy die casting material of the present invention is obtained from the aluminum alloy of the present invention which not only has high strength and elongation (toughness) but also has excellent castability, the member having a complicated shape can be obtained. Further, since the variation in composition depending on the portion due to the cooling rate at the time of die casting is suppressed, it has uniform mechanical properties regardless of the portion. In addition, the effect of aging after being manufactured by die casting is small, and substantially the same tensile properties can be maintained.

In the aluminum alloy die casting material of the present invention, in the cross-sectional structure observation, it is preferable that the average value of the equivalent circle diameter of the eutectic Si structure is 3 μm or less, and the area ratio of the Cr-based crystallized product to the whole is 10% or less. When the average value of the equivalent circle diameter of the eutectic Si structure and the area ratio of the Cr-based crystallized product to the whole are these values, the proof stress and the elongation can be improved.

Effects of the Invention

According to the present invention, it is possible to provide a non-heat-treated aluminum alloy which has excellent casting properties and is high in both strength and toughness. According to the present invention, it is also to provide an aluminum alloy die casting material which is high in both strength and toughness, and which, in addition to having minimal difference in characteristics between regions thereof, is not prone to be affected by aging.

EMBODIMENTS FOR ACHIEVING THE INVENTION

Figure 1:
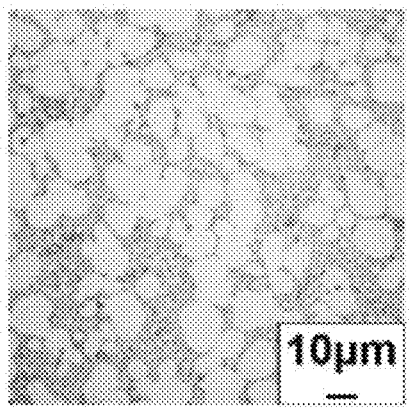
FIG. 1 shows an optical micrograph of the cross section of the example aluminum alloy die casting material 1.

Hereinafter, typical embodiments of the aluminum alloy and the aluminum alloy die casting material of the present invention will be described in detail, but the present invention is not limited to these.

1. Aluminum Alloy

The aluminum alloy of the present invention contains Si: 5.0 to 12.0% by mass, Mn: 0.3 to 1.9% by mass, Cr: 0.01 to 1.00% by mass, Ca: 0.001 to 0.050% by mass, with the balance being Al and unavoidable impurities, and the content of Mg in the unavoidable impurities being less than 0.3% by mass. Hereinafter, each component will be described in detail.

(1) Additive Element

Si: 5.0 to 12.0% by Mass

Si has a function of improving the flow of molten metal to improve castability. When not reaching the lower limit, the castability becomes insufficient, and when exceeding the upper limit, since the formation of the crystallized product, which is the starting point of fracture, adversely affects the elongation, it is necessary to limit within the above range. In order to achieve both castability and elongation at a better level, Si: 7.0 to 12.0% by mass is preferable, and Si: 8.0 to 11.0% by mass is more preferable.

Mn: 0.3 to 1.9% by Mass

Mn must be contained in a certain amount in order to prevent the molten metal from being seized on the mold during casting. When being less than the lower limit of the specified range, the effect is not sufficient, and when exceeding the upper limit, primary crystals of Al—Mn compounds are generated, and since, if this forms coarse crystallized products, ductility is adversely affected, it is limited within the above range. In order to achieve both toughness and castability, the upper limit of Mn is preferably 1.4% by mass, more preferably 1.0% by mass, and most preferably 0.8% by mass.

Cr: 0.01 to 1.00 Mass %

Cr is dissolved in the matrix to mainly improve the proof stress. When being less than the lower limit, the effect is small, and when adding beyond the upper limit, though the adverse effect on proof stress is small, since coarse Cr-based crystallized product is formed which is the starting point of fracture due to stress concentration, this adversely affects the ductility, it is necessary to limit within the above range. In order to obtain the effect of solid solution strengthening more reliably, addition of 0.10% by mass or more is preferable. It should be noted that, with the addition of about 0.50% by mass, since crystallized products containing Cr, but not coarse, will appear, in this composition, the limit at which Cr contributes to the proof stress as a solid solution strengthening element is approximately this value. Since the addition of more than this is a factor of increasing the cost, the upper limit is preferably 0.50% by mass, more preferably 0.40% by mass.

Ca: 0.001 to 0.050% by Mass

Ca mainly contributes to elongation by refining the eutectic Si structure. When being less than the lower limit, the effect is small, and even when adding beyond the upper limit, there is no effect because the eutectic Si structure has already been sufficiently refined. Further, when containing excessively, the crystallized product becomes coarse and adversely affects the toughness. In addition, since the addition of Ca is a cost-increasing factor, it is necessary to limit the upper limit within the above range. Though the effect of improving the eutectic Si structure can be obtained by adding Sr, Sb, and Na, in the composition of the present invention, elongation tends to be slightly inferior to that of Ca.

In addition, one or more of Ti: 0.05 to 0.20% by mass, B: 0.005 to 0.100% by mass, and Zr: 0.05 to 0.20% by mass may be further added. Since Ti, B, and Zr mainly contribute to toughness by refining the structure, it is preferably added. When being less than the lower limit, the effect is small, and even when containing beyond the upper limit, it is already sufficiently finely divided and has no effect, and, in addition thereto, when adding excessively, it adversely affects ductility by forming the coarse crystallized products, therefore it is necessary to limit within the above range.

(2) Inevitable Impurities

Mg: Less than 0.3% by Mass

The aluminum alloy of the present invention is expected to be used in situations and cases where the adverse effects of Mg described in the above PRIOR ARTS are undesired in the product. Accordingly, Mg needs to be regulated at a low level. In order to more reliably avoid the above adverse effects, the Mg content is preferably limited to less than 0.1% by mass, more preferably less than 0.08% by mass.

Fe: 0.4% by Mass or Less

Generally, Fe is often added for the purpose of preventing the molten metal from being seized onto the mold during casting. On the other hand, in the aluminum alloy of the present invention, the addition of Fe forms Al—Fe—Si compounds and Fe—Si compounds, which adversely affect the ductility. Accordingly, Fe is preferably regulated to 0.4% by mass or less, more preferably 0.2% by mass or less.

The method for producing the aluminum alloy of the present invention having the above composition is not particularly limited as long as the effect of the present invention is not impaired, and the molten aluminum alloy having the desired composition may be melted by various conventionally known methods.

Impurities such as hydrogen gas and oxides are mixed in the molten metal that is melted in the atmosphere, and when this molten metal is cast as it is, defects such as porosity are appeared during solidification, which results in inhibiting the toughness of the produced member. In order to prevent these defects, it is effective to perform bubbling with an inert gas such as nitrogen or argon gas after melting the molten metal and before die casting. The inert gas supplied from the lower part of the molten metal, when ascending, has the function of catching hydrogen gas and impurities in the molten metal and removing them to the surface of the molten metal.

2. Aluminum Alloy Die Casting Material

The aluminum alloy die casting material of the present invention is a die casting material made of the aluminum alloy of the present invention having a tensile property of 0.2% proof stress of 110 MPa or more and elongation of 10% or more.

Both excellent 0.2% proof stress and elongation of the aluminum alloy die casting material are basically realized by seriously optimizing the composition, and the desired tensile properties are obtained regardless of the shape and size of the aluminum alloy die casting material. Here, the 0.2% proof stress is preferably 115 MPa or more, and the elongation is preferably 15% or more.

Further, in the aluminum alloy die casting material of the present invention, it is preferable that the average value of the equivalent circle diameter of the eutectic Si structure is 3 μm or less, and the cross-sectional area ratio of the Cr-based crystallized product to the whole is 10% or less. Dou to this microstructure, the high proof stress and elongation can be obtained. At this time, the method for determining the average value in the equivalent circle diameter of the eutectic Si structure and the cross-sectional area ratio of the Cr-based crystallized product to the whole is not particularly limited, and the measurement may be performed by various conventionally known methods. For example, the size of the eutectic Si structure or the Cr-based crystallized product can be obtained by cutting the aluminum alloy die casting material, observing the obtained cross-sectional sample with an optical microscope or a scanning electron microscope, and calculating. Depending on the observation method, the cross-sectional sample may be subjected to mechanical polishing, buffing, electrolytic polishing, etching or the like.

The shape and size of the aluminum alloy die casting material are not particularly limited as long as the effects of the present invention are not impaired, and can be made to various conventionally known members. Examples of the member include a vehicle body structural member.

3. Method for Manufacturing Aluminum Alloy Die Casting Material

The aluminum alloy die casting material of the present invention is a die casting material made of the aluminum alloy of the present invention. The die casting method for obtaining the aluminum alloy die casting material is not particularly limited as long as the effects of the present invention are not impaired, and various conventionally known methods and conditions may be used, and in the following, an example of manufacturing conditions for the aluminum alloy for die casting will be described.

Since the aluminum alloy used as the raw material of the aluminum alloy die casting material of the present invention contains the element for the purpose of solid solution strengthening, it is necessary to pay attention to the cooling rate in the production of the die casting material. When the cooling rate at the time of casting is slow, Mn, Cr and Ca cannot be sufficiently solid-solved in the matrix, and therefore, it is preferable to secure a cooling rate of 50° C./sec or more at the time of casting. At this time, the casting pressure may be set from 50 MPa to 150 MPa.

Further, in the manufacturing of a member using the die casting method, since the molten metal is poured into the mold at high pressure and high speed, there is a case that air in the mold is involved in the molten metal, or a case that due to solidification shrinkage, defects such as bubbles, and nests are occur in the member. Since the presence of many such defects adversely affects the toughness of the member, it is preferable to take technical measures to reduce these defects during casting.

Further, the aluminum alloy for die casting of the present invention is a non-heat treatable type aluminum alloy, and does not require heat treatment on the product after casting in order to obtain the mechanical properties required for, for example, the vehicle members in the die casting material. As a result, it is possible to reduce the cost related to the heat treatment step and the correction of the strain generated by the heat treatment step.

Although the typical embodiments of the present invention have been described above, the present invention is not limited to these, and various design changes are possible, and all of these design changes are included in the technical scope of the present invention.

EXAMPLES

Example 1

After melting the aluminum alloy having the composition shown in Example 1 in TABLE 1, the example aluminum alloy die casting material 1 was obtained by die casting. The values in TABLE 1 are % by mass, and the balance is Al.

TABLE 1

| | Si | Mn | Ti | Fe | Ca | Cr | Mg |
|---|---|---|---|---|---|---|---|
| Ex.1 | 9.7 | 0.53 | 0.15 | 0.12 | 0.010 | 0.19 | — |
| Ex.2 | 9.2 | 0.48 | 0.14 | 0.13 | 0.010 | 0.45 | — |
| Ex.3 | 9.4 | 0.49 | 0.13 | 0.12 | 0.008 | 0.73 | — |
| Com. Ex.1 | 9.5 | 0.49 | 0.08 | 0.10 | 0.010 | — | — |
| Com. Ex.2 | 9.5 | 0.48 | 0.09 | 0.15 | 0.006 | — | 0.43 |

As a die casting method, a non-porous die casting method was adopted to produce a die casting material. The size of the mold used at this time was 110 mm×110 mm×3 mm, the casting was conducted under the condition that the casting pressure at the time of die casting was 120 MPa, the molten metal temperature was 730° C., and the mold temperature was 160° C. A water-soluble release agent was used.

Example 2

An example aluminum alloy die casting material 2 was obtained in the same manner as in Example 1 except that the aluminum alloy having the composition shown in Example 2 in TABLE 1 was melted.

Example 3

An example aluminum alloy die casting material 3 was obtained in the same manner as in Example 1 except that the aluminum alloy having the composition shown in Example 3 in TABLE 1 was melted.

Comparative Example 1

A comparative aluminum alloy die casting material 1 was obtained in the same manner as in Example 1 except that the aluminum alloy having the composition shown as Comparative Example 1 in TABLE 1 was melted.

Comparative Example 2

A comparative aluminum alloy die casting material 2 was obtained in the same manner as in Example 1 except that the aluminum alloy having the composition shown as Comparative Example 2 in TABLE 1 was melted.

[Tensile Test]

A 14B test piece specified in JIS-Z2241 was collected from the obtained example aluminum alloy die casting materials 1 to 3 and comparative aluminum alloy die casting materials 1 and 2, and when a tensile test was conducted at room temperature, the results of the 0.2% resistance and the elongation at break are as shown in TABLE 2, respectively.

TABLE 2

| | 0.2% proof stress (MPa) | Elongation at break (%) |
|---|---|---|
| Ex. 1 | 119 | 15 |
| Ex. 2 | 110 | 16 |
| Ex. 3 | 112 | 16 |
| Com. Ex. 1 | 103 | 14 |
| Com. Ex. 2 | 151 | 8 |

All of the example aluminum alloy die casting materials 1 to 3 satisfy 0.2% proof stress of 110 MPa or more and elongation of 10% or more. On the other hand, in the comparative aluminum alloy die casting material 1, since Cr is not added in an appropriate amount, the 0.2% proof stress remains at 103 MPa. Further, in the comparative aluminum alloy die casting material 2, high proof stress is obtained by adding Mg, but a decrease in ductility due to the Mg—Si compound is observed, and the elongation is 8%.

[Structural Observation]

Figure 2:
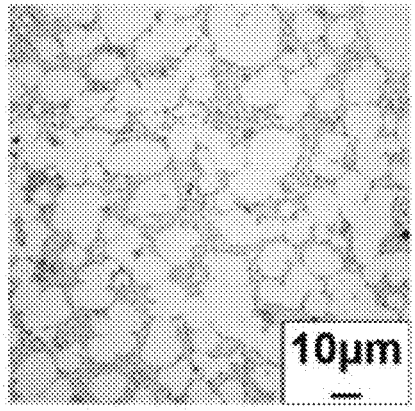
FIG. 2 shows an optical micrograph of the cross section of the example aluminum alloy die casting material 2.
Figure 3:
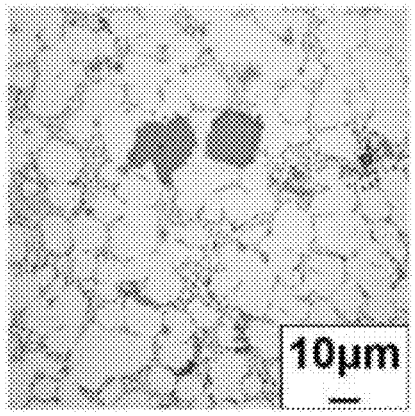
FIG. 3 shows an optical micrograph of the cross section of the example aluminum alloy die casting material 3.
Figure 4:
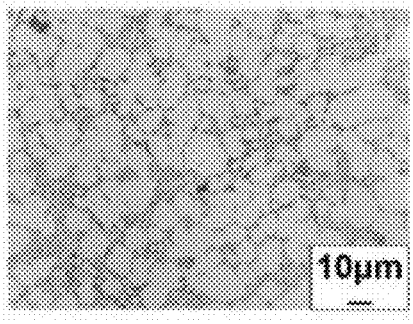
FIG. 4 shows an optical micrograph of the cross section of the comparative example aluminum alloy die casting material 1.

The cross sections of the example aluminum alloy die casting materials 1 to 3 and the comparative aluminum alloy die casting material 1 were mirror-polished and observed with an optical microscope. The optical micrograph of the example aluminum alloy die casting material 1 is shown in FIG. 1, the optical micrograph of the example aluminum alloy die casting material 2 is shown in FIG. 2, the optical micrograph of the example aluminum alloy die casting material 3 is shown in FIG. 3, and the comparative aluminum alloy die casting material 1 is shown in FIG. 4, respectively.

When the field of 100 μm×100 μm selected from the optical micrographs of the example aluminum alloy die casting material 3 was targeted for image analysis, and the average value of the equivalent circle diameter of the eutectic Si structure and the cross-sectional area ratio of the Cr-based crystallized product to the whole were measured, the average value of the equivalent circle diameter of the eutectic Si structure was 2 μm, and the cross-sectional area ratio of the Cr-based crystallized product to the whole was 7%.

The invention claimed is:

1. An aluminum alloy consisting of
Si: 7.0 to 12.0% by mass,
Mn: 0.3 to 1.9% by mass,
Cr: 0.01 to 1.00% by mass,
Ca: 0.001 to 0.050% by mass, and
optionally one or more selected from a group consisting of Ti: 0.05 to 0.20% by mass, B: 0.005 to 0.100% by mass and Zr: 0.05 to 0.20% by mass,
with the balance being Al and unavoidable impurities, and
the content of Mg in the unavoidable impurities being less than 0.3% by mass.

2. The aluminum alloy according to claim 1, wherein a Cr content is 0.10 to 0.50% by mass.

3. The aluminum alloy according to claim 1, wherein Fe is 0.4% by mass or less in the unavoidable impurities.

4. The aluminum alloy according to claim 3, wherein Fe is 0.2% by mass or less.

5. An aluminum alloy die casting material comprising the aluminum alloy according to claim 1, which has a tensile property of 0.2% proof stress of 110 MPa or more and elongation of 10% or more.

6. The aluminum alloy die casting material according to claim 5, wherein, in a cross-sectional structure observation,
an average value of an equivalent circle diameter of an eutectic Si structure is 3 μm or less, and
a cross-sectional area ratio of a Cr-based crystallized product to the whole is 10% or less.

7. The aluminum alloy according to claim 1, wherein the content of Mg in the unavoidable impurities is less than 0.1% by mass.

8. The aluminum alloy according to claim 1, wherein the content of Mg in the unavoidable impurities is less than 0.08% by mass.

9. An aluminum alloy die casting material consisting of
Si: 7.0 to 12.0% by mass,
Mn: 0.3 to 1.9% by mass,
Cr: 0.01 to 1.00% by mass,
Ca: 0.001 to 0.050% by mass, and
optionally one or more selected from a group consisting of Ti: 0.05 to 0.20% by mass, B: 0.005 to 0.100% by mass and Zr: 0.05 to 0.20% by mass,
with the balance being Al and unavoidable impurities, and
the content of Mg in the unavoidable impurities being less than 0.3% by mass.

10. The aluminum alloy die casting material according to claim 9, wherein the content of Mg in the unavoidable impurities is less than 0.1% by mass.

11. The aluminum alloy die casting material according to claim 9, wherein the content of Mg in the unavoidable impurities is less than 0.08% by mass.

* * * * *